US006288684B1

(12) United States Patent
Wiggenhorn et al.

(10) Patent No.: US 6,288,684 B1
(45) Date of Patent: Sep. 11, 2001

(54) ANTENNA MOUNTING APPARATUS

(75) Inventors: James T. Wiggenhorn, Coral Springs; John F. Murray, Miami Springs, both of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/642,382

(22) Filed: Aug. 22, 2000

(51) Int. Cl.[7] ..... H01Q 21/00
(52) U.S. Cl. ..... 343/713; 335/288
(58) Field of Search ..... 343/715, 713, 343/878; 246/906; 335/288, 295

(56) References Cited

U.S. PATENT DOCUMENTS 5,926,655 * 7/1999 Irie et al. ..... 396/51
6,023,245 * 2/2000 Gomez et al. ..... 343/725

* cited by examiner

*Primary Examiner*—Don Wong
*Assistant Examiner*—James Clinger
(74) *Attorney, Agent, or Firm*—Frank M. Scutch, III

(57) ABSTRACT

A mounting apparatus (100) suitable for retaining an antenna (112) includes a base (102) having magnetic sources (104) and (106) capable of providing varying magnetic forces. Magnet (104) retains the base against a metal surface (410), while an electronically controlled magnet (106) provides additional retention of the base (102) against the metal surface (410) when activated, thereby preventing movement of the base and antenna (112).

7 Claims, 3 Drawing Sheets

ANTENNA MOUNTING APPARATUS

TECHNICAL FIELD

This invention relates to antennas, and more particularly to antenna mounting apparatus for mobile radio systems.

BACKGROUND

Mobile radio systems typically utilize an external antenna mounted to the outside of a vehicle. A variety of mounting structures are available, however, the magnetic mounting structure is one of the more popular. Unfortunately, currently available magnetic mounting structures have the disadvantage of being easily dislocated. Today's magnetic base mount antennas usually do not have adequate holding force for large antennas used in the low frequency range, such as the 30 MHz–50 MHz range. Antennas having lengths of more than one meter are quite common, and when used on a vehicle, can be jarred lose from the mounting surface. Increasing the magnetic strength of the magnet solves the dislocation problem, but creates the disadvantage of being unable to move the antenna structure—a feature often desired by mobile radio users.

Accordingly, there is a need for an improved antenna mounting apparatus that provides increased surface retention while providing the mobility that users desire.

DETAILED DESCRIPTION OF THE PREFERRED EMBODIMENT

Figure 1:
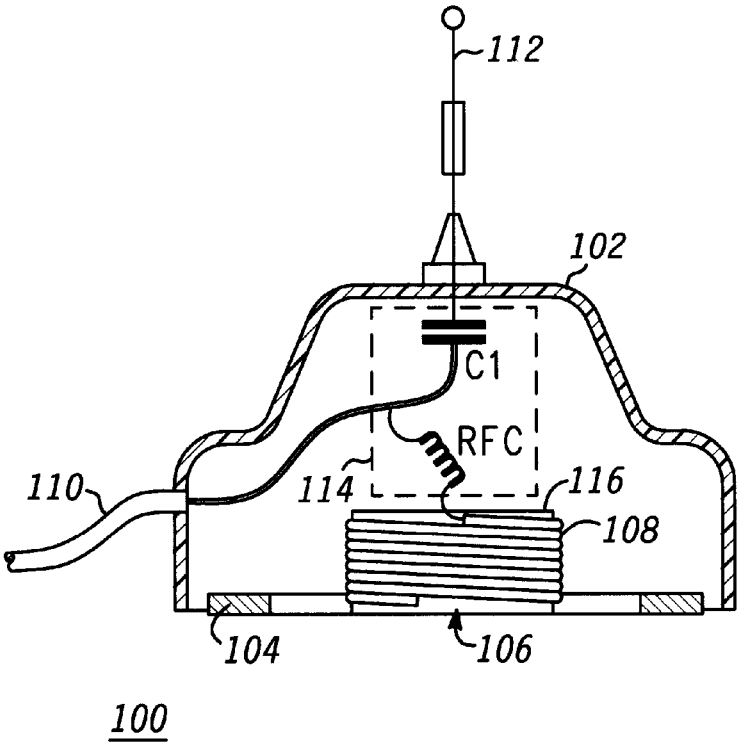
FIG. 1 is a cross-sectional view of an antenna mounting apparatus in accordance with the present invention.

While the specification concludes with claims defining the features of the invention that are regarded as novel, it is believed that the invention will be better understood from a consideration of the following description in conjunction with the drawing figures, in which like reference numerals are carried forward.

Briefly, in accordance with the present invention, a mounting base to be described herein operates with a strong magnetic force for increased holding capability and a weaker magnetic force for user mobility. In accordance with the present invention, an electronically controlled magnet is included within base to retain the base against a metal surface with increased force when activated.

Referring now to FIG. 1, there is shown a cross sectional view of an antenna mounting apparatus 100 in accordance with the present invention. The antenna mounting apparatus 100 includes a base 102 having first and second magnetic sources 104, 106 respectively (which will also be referred to as first and second magnets 104, 106). The first magnetic source 104 is used for retaining the base against a metal surface in a manner consistent with the prior art. In accordance with the present invention, the second magnetic source 106 is electronically activated for providing additional retention of the base against the metal surface. Magnetic source 106 is preferably formed of a core 116, for example a steel core, surrounded by a coil 108, such as a copper coil. A thin cover plate (not shown) may be added, if desired, to the bottom of base 102 to protect contact surfaces from being scratched. Electronic energizing of magnetic source 106 is preferably achieved by operatively coupling the magnetic source to an external electrical source, such as a vehicle ignition system. Appropriate interface connection can be made by suitable coaxial interconnect 110. Antenna 112 is also preferably coupled to a mobile radio via coaxial interconnect 110 or similar interconnect device. Radio frequency (RF) choke(s) and capacitor(s) 114 as well as other electronic interfacing can also be included as needed for isolation, bypass, and desense.

Figure 2:
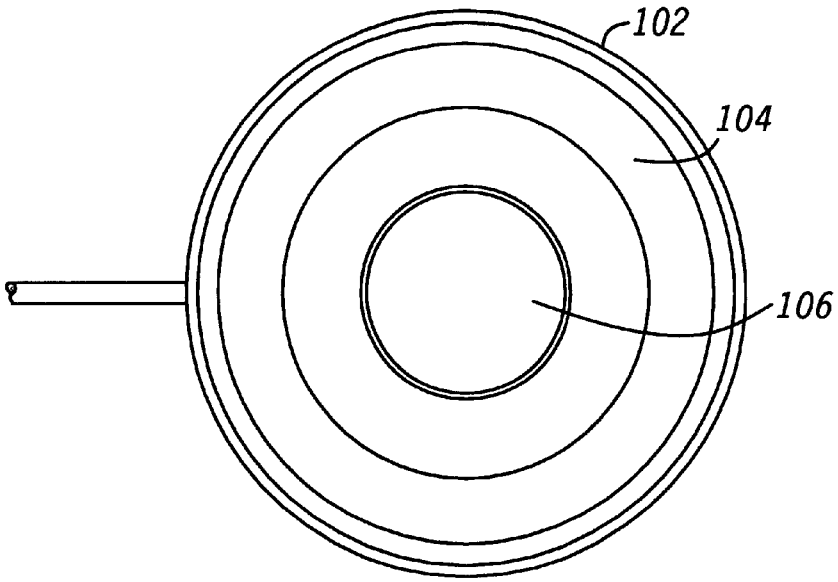
FIG. 2 is a bottom view of the antenna mounting apparatus of FIG. 1 in accordance with the present invention.

FIG. 2 is a bottom view of the antenna mounting apparatus 100 of FIG. 1 in accordance with a preferred embodiment of the invention. In this view, magnet 104 is shown as having a circular shape following the perimeter of the base 102. First magnet 104 provides continuous magnetic retention when coupled against a metal surface and allows the attachment and detachment of the base 102 by a user to and from the metallic surface. In accordance with the present invention, the second magnet 106 provides switchable magnetic retention. The switchable magnetic retention of magnet 106 is turned on by activating external circuitry thereby increasing the base's magnetic holding force and preventing movement of the base on the metallic surface. Thus, the first magnetic source 104 retains the base against a metal surface with a first predetermined magnetic force, and the second magnetic source 106 is electronically activated to retain the base against the metal surface with a second predetermined magnetic force. The layout and positioning of the magnets is a matter of design choice and, though shown as an inner center and outer perimeter, other magnetic layout configurations can work equally as well. Additional magnets can be used as well depending on the size and shape of the base, limited only by the surface area onto which the base is to be placed.

Figure 3:
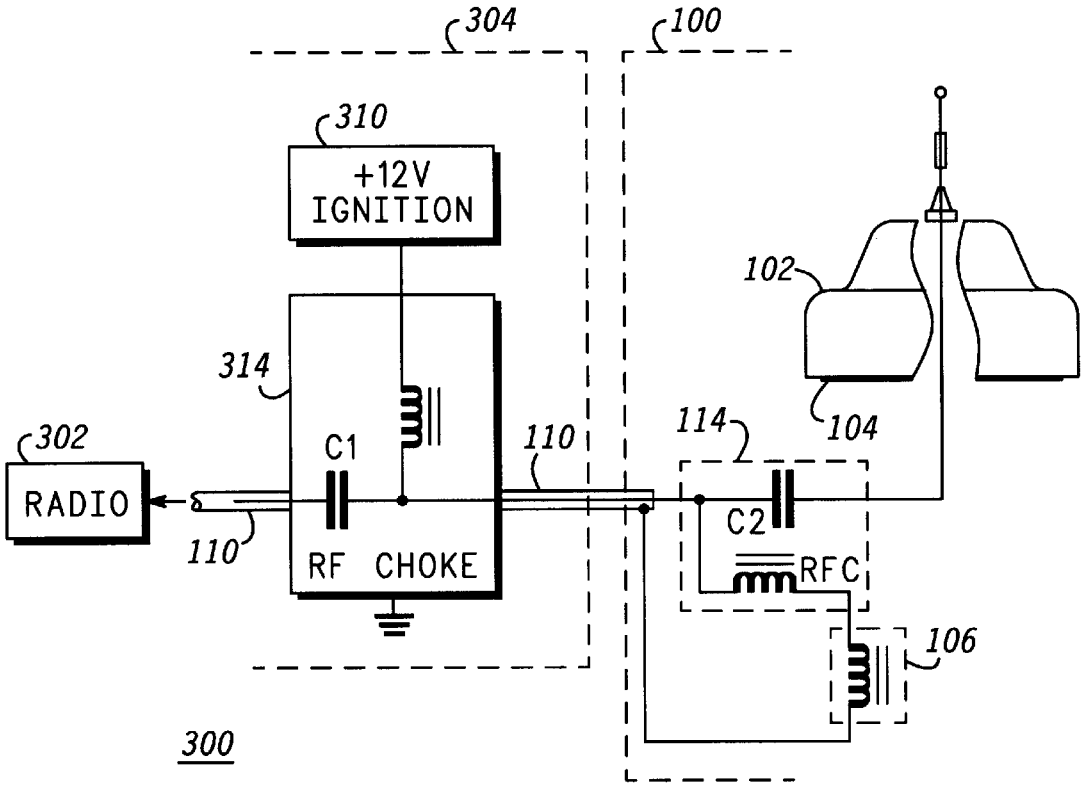
FIG. 3 is a system view showing the antenna mounting apparatus of the present invention incorporated into a vehicular environment.

FIG. 3 is a system view showing the antenna mounting apparatus of the present invention incorporated into a vehicular environment. System 300 includes a radio 302 located within a vehicle 304 and coupled through appropriate interface connections 110 to the antenna mounting base 102. In accordance with the invention, the base 102 is magnetically coupled to the vehicle using first and second magnetic modes. The first magnetic mode allows the base to be attached and detached to and from the vehicle, while the second magnetic mode utilizes the electronically controlled magnet 106 to prevent movement of the base when activated. Activation and deactivation of the electronically controlled magnet 106 is preferably controlled by the vehicle's ignition system 310. Appropriate RF choke circuitry 114 is incorporated as needed to avoid interference with the antenna's 112 transmission and reception. Other appropriate RF chokes and capacitors 314 are preferably included as needed for power supply isolation and desense protection. Though shown tied to the vehicle's ignition 310, the electronically controlled magnet 106 may, alternatively, be controlled by other circuitry within the car, such as the lights, or even dedicated circuitry and switch if desired.

Figure 4:
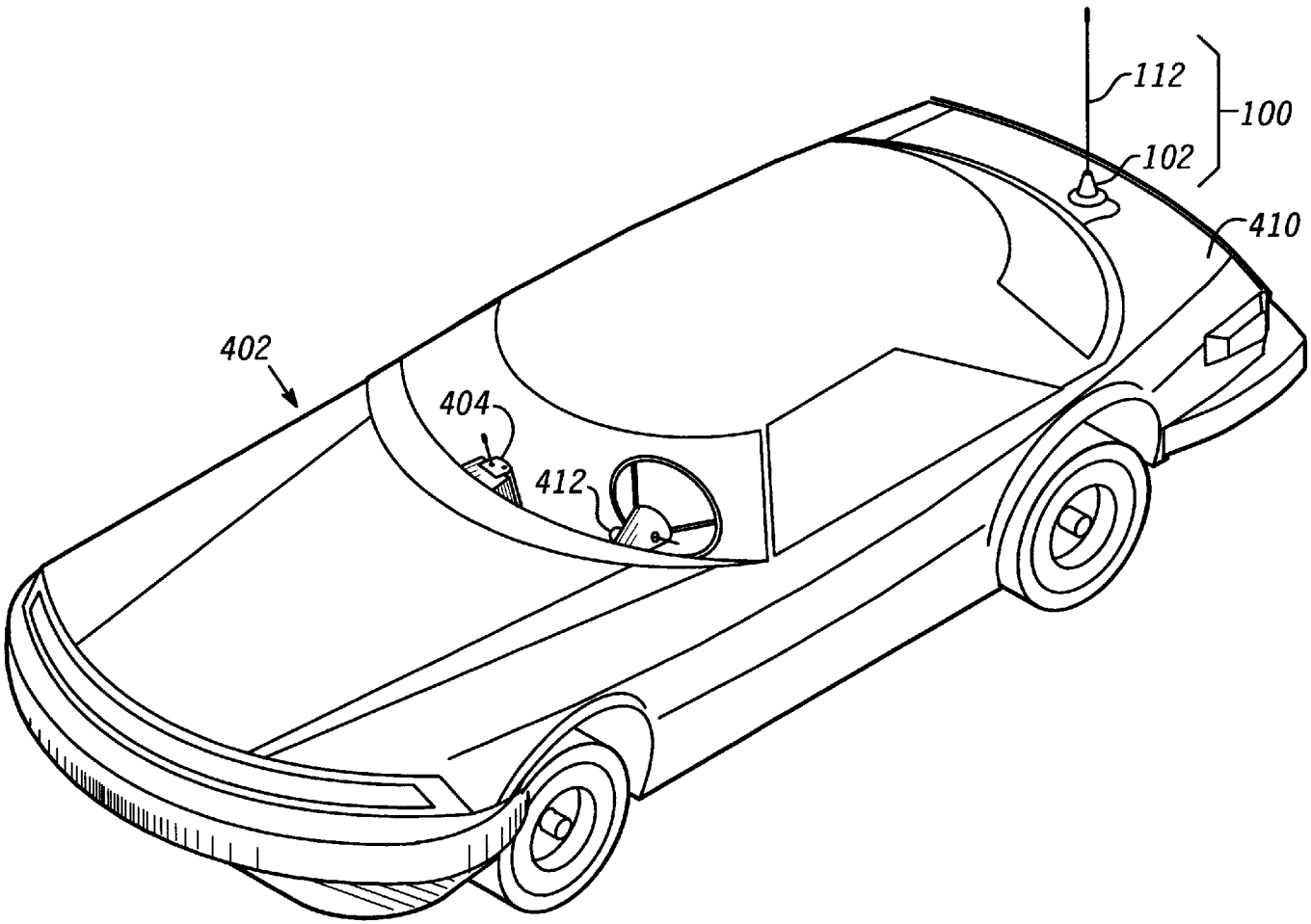
FIG. 4 shows the antenna mounting apparatus of the present invention mounted on a vehicle.

Referring now to FIG. 4 there is shown a vehicle 402 including the antenna mounting apparatus 100 in accordance with a preferred embodiment of the invention. A radio 404 is located in the vehicle 402 with RF porting of the radio being operatively coupled to external antenna 112. The standard magnet 104 (shown in other views) is used for retaining the base against the vehicle's metal surface 410 to allow attachment and removal of the base. In accordance with the invention, the second magnet 106 (shown in other views) is used for electro-coupling the base 102 against the vehicle's metal surface 410 when energized by an external source, in this case the vehicle's ignition system 412. Thus, when the vehicle is turned on movement of the base 102 on the car's metal surface 410 is prevented. When the vehicle is turned off, the second magnetic source 106 is deactivated thereby allowing the base 102 to be removed by a user.

Thus, an improved mounting apparatus has been provided by including an electronically controlled magnet within the base for retaining the base against a metal surface when activated. The extra retention provided by a second electronically controlled magnetic source allows an antenna to remain securely attached to a vehicular surface. High winds, rough terrain, and low overpasses will not jar the antenna off of the vehicle thus providing improved reliability over the typical base mount antenna. The antenna mounting apparatus of the present invention is easily incorporated into the vehicular environment. The base is forcibly retained by turning on a vehicle's ignition and then easily removed by turning off the ignition. Thus, the apparatus can be removed from the vehicle surface when parked thereby preventing vandalism to the antenna structure and allowing the user to move the antenna to another car if desired.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An apparatus for mounting an antenna to a metal surface, comprising:

a base for coupling the antenna to a surface;

a first magnet coupled to the base for retaining the base against the surface;

a second magnet coupled to the base, the second magnet for electro-coupling the base against the surface when energized by an external source; and wherein the external source comprises electronics associated with a vehicle.

2. An antenna mounting apparatus, comprising a base having first and second magnetic sources, the first magnetic source for retaining the base against a metal surface with a first predetermined magnetic force, the second magnetic source being electronically activated for retaining the base against the metal surface with a second predetermined magnetic force; and wherein the second magnetic source is electronically activated by a vehicle.

3. A mounting apparatus for an antenna, comprising:

a base for retaining the antenna;

a magnet for retaining the base against a metal surface;

an electronically controlled magnet for providing additional retention of the base against the metal surface when activated; and wherein the electronically controlled magnet is actuated through the use of a vehicular power source.

4. A base mount for a metal surface, comprising:

a first magnet providing continuous magnetic retention;

a second magnet providing switchable magnetic retention; and wherein the switchable magnetic retention is controlled through the use of a vehicular power source.

5. The base mount of claim 4, wherein the base mount is used for retaining an antenna.

6. A base for mounting an antenna to a metal surface, comprising:

a first magnet coupled to the base, the first magnet for attaching and detaching the antenna to and from the metal surface;

a second magnet coupled to the base, the second magnet being electronically controlled to provide permanent attachment of the base to the metal surface when activated; and wherein the electronic control is provided through the use of a vehicular power source.

7. A mobile radio for a vehicular environment, comprising:

a radio mounted within a vehicle;

an external antenna mounted to the vehicle and coupled to the radio;

a base for holding the external antenna, the base magnetically coupling to the vehicle using first and second magnetic modes, the first magnetic mode utilizing a magnet for attaching and detaching the base to and from the vehicle, the second magnetic mode utilizing an electronically controlled magnet to prevent removal of the base when activated; and wherein the electronic control is provided through the use of a vehicular power source.

* * * * *